US006137969A

United States Patent [19]

Tsujimoto

[11] Patent Number: 6,137,969

[45] Date of Patent: Oct. 24, 2000

[54] THERMAL FIXING DEVICE, METHOD OF ENERGIZING A HEATING MEMBER IN THE THERMAL FIXING DEVICE AND IMAGE FORMING APPARATUS

[75] Inventor: Takahiro Tsujimoto, Toyokawa, Japan

[73] Assignee: Minolta Co., Ltd., Osaka, Japan

[21] Appl. No.: 09/248,293

[22] Filed: Feb. 11, 1999

[30] Foreign Application Priority Data

Feb. 12, 1998 [JP] Japan ..... 10-029841

[51] Int. Cl.[7] ..... G03G 15/20

[52] U.S. Cl. ..... 399/69; 219/216; 399/333; 399/334

[58] Field of Search ..... 399/67, 69, 70, 399/320, 328, 330, 333, 334, 335; 219/216, 469, 470, 471

[56] References Cited

U.S. PATENT DOCUMENTS 4,801,968 1/1989 Kogure et al. ..... 399/334
5,822,670 10/1998 Morigami ..... 399/334
5,906,762 5/1999 Okabayashi ..... 399/69 X

*Primary Examiner*—Sophia S. Chen
*Assistant Examiner*—Hoan Tran
*Attorney, Agent, or Firm*—McDermott, Will & Emery

[57] ABSTRACT

A thermal fixing device for thermally fixing an unfixed image carried on a record medium onto the record medium, including: a thermal fixing roller including a first resistance heating material layer (e.g., the resistance heating material layer also serving as a core roller) and a second resistance heating material layer; a power source circuit capable of forming a first circuit for energizing only the first resistance heating material layer and a second circuit for energizing the first and second resistance heating material layers by connecting them in parallel; and a controller for controlling energizing of each of the resistance heating material layers by the power source circuit, wherein the controller controls the power source circuit such that only the first resistance heating material layer is energized until a predetermined time elapses after start of the temperature rising of the thermal fixing roller, and the first and second resistance heating material layers are connected in parallel and energized after elapsing of the predetermined time.

30 Claims, 6 Drawing Sheets

FIRST SSR1 ON
SECOND SSR2 ON
T1
SECOND SSR2 OFF
SAME AREA
α
α'
β
β'
Y
Y'
X
t1
t2
t3
200° C
200° C
TIME
15
10
5
RESTRICTED CURRENT VALUE
CURRENT [A]

THERMAL FIXING DEVICE, METHOD OF ENERGIZING A HEATING MEMBER IN THE THERMAL FIXING DEVICE AND IMAGE FORMING APPARATUS

The invention is based on patent application No. 10-29841 Pat. filed in Japan, the contents of which are hereby incorporated by reference.

BACKGROUND OF THE INVENTION

1. Field of the Invention

The present invention relates to a thermal fixing device which is used in an image forming apparatus such as a copying machine, a printer, a facsimile machine or the like, and particularly a thermal fixing device including a resistance heating material layer, which generates heat from its surface when energized, i.e., when supplied with a current, for thermally fixing an unfixed image carried on a record medium onto the record medium by utilizing the surface-generated heat.

The invention also relates to a method of energizing a heating member in the thermal fixing device for raising the temperature of the heating member.

Further, the invention relates to an image forming apparatus provided with the thermal fixing device.

2. Description of the Background Art

The thermal fixing device in the image forming apparatus such as a copying machine, a printer, a facsimile machine or the like is generally provided with a thermal fixing roller. A record medium carrying an unfixed image such as a toner image is passed between the fixing roller and a backup member (generally, a pressure roller) under a pressure so that the unfixed image is fixed onto the record medium by heat and pressure.

A large amount of heat is required for heating the fixing roller.

Recently, it has been demanded to reduce a power consumption of the image forming apparatus during not only an image forming operation but also standby. Reduction in required electric power of the thermal fixing device is one of factors which contribute to reduction in power consumption of the apparatus.

For example, the thermal fixing device in the prior art, which applies the heat and pressure to the unfixed image carried on the record media for fixing the image onto the record media as described above, has such a structure that a heater such as a halogen heater is arranged within the thermal fixing roller for heating the fixing roller by heat radiated therefrom. In another structure, the fixing roller is heated by a heater of a sheet-like form, i.e., a so-called sheet heater, which is formed on a core roller of the fixing roller and made of a material generating heat when energized, i.e., when supplied with a current.

In the above thermal fixing device which uses the internal heater such as halogen heater or the like as the heat source, the electrothermal energy conversion efficiency is generally about 70%, and conversion loss of about 30% occurs.

In the above thermal fixing device which uses the sheet heater as the heat source, the electrothermal energy conversion efficiency is extremely high so that the power consumption of the image forming apparatus can be low, and thus the required electric power can be significantly reduced.

If such a sheet heater is used that has a capacity equal to that of the internal heater such as a halogen heater, a preheating time (i.e., a so-called warm-up time) which is required for heating the fixing roller to a predetermined temperature can be significantly reduced because the sheet heater has a high electrothermal energy conversion efficiency.

Accordingly, the sheet heater having a high electrothermal energy conversion efficiency can be effectively used as the heat source of the thermal fixing device from the viewpoint of reduction in required electric power.

However, the thermal fixing device employing the sheet heater has such features that a current which flows therethrough at the time of start of heating, i.e., when the fixing roller is cold (at the room temperature) is larger than that which flows when the fixing roller is warmed up. The feature that a large current flows at a low temperature is a general feature of the electrically conductive material, and the above heating layer has the same feature. An electrical resistance value rises with temperature.

In the thermal fixing device using the sheet heater as the heat source, therefore, a large current may flow even if only a small current will flow through the heat generating material layer after the fixing roller reaches the predetermined temperature suitable to fixing, because the electrical resistance value of the heat generating material layer is low during an initial stage of the temperature rising, i.e., when the temperature of the fixing roller is low.

For preventing this, such a structure may be employed that the heat generating material layer having a high electrical resistance value is employed for restricting the current flowing through the heat generating material layer in the initial stage of the temperature rising of the fixing roller. According to this structure, however, the current flowing through the heat generating body is reduced so that the temperature rising rate of the fixing roller is reduced.

SUMMARY OF THE INVENTION

An object of the invention is to provide a thermal fixing device provided with a heating member utilizing, as a heat source, a resistance heating material layer, which generates heat when energized, for thermally fixing an unfixed image carried on a record medium onto the record medium, and particularly a thermal fixing device in which an input current supplied to the resistance heating material layer can be controlled, and the temperature of the heating member can be rapidly raised to a predetermined fixing temperature without lowering a temperature rising rate of the heating member.

Another object of the invention is to provide a thermal fixing device provided with a heating member utilizing, as a heat source, a resistance heating material layer, which generates heat when energized, for thermally fixing an unfixed image carried on a record medium onto the record medium, and particularly a thermal fixing device in which an input current supplied to the resistance heating material layer can be restricted to or below a predetermined restricted current, and the temperature of the heating member can be rapidly raised to a predetermined fixing temperature without lowering a temperature rising rate of the heating member.

Still another object of the invention is to provide a method of energizing a heating member of a thermal fixing device provided with the heating member utilizing, as a heat source, a resistance heating material layer, which generates heat when energized, for thermally fixing an unfixed image carried on a record medium onto the record medium, and particularly a energizing method in which an input current supplied to the resistance heating material layer can be controlled, and the temperature of the heating member can be rapidly raised to a predetermined fixing temperature without lowering a temperature rising rate of the heating member.

Yet another object of the invention is to provide a method of energizing a heating member of a thermal fixing device provided with the heating member utilizing, as a heat source, a resistance heating material layer, which generates heat when energized, for thermally fixing an unfixed image carried on a record medium onto the record medium, and particularly a energizing method in which an input current supplied to the resistance heating material layer can be restricted to or below a predetermined restricted current, and the temperature of the heating member can be rapidly raised to a predetermined fixing temperature without lowering a temperature rising rate of the heating member.

Further another object of the invention is to provide an image forming apparatus having a thermal fixing device provided with a heating member for thermally fixing an unfixed image carried on a record medium onto the record medium, and particularly an image forming apparatus, in which the thermal fixing device can safely and rapidly reach a fixing allowing temperature, and thereby image formation can be performed smoothly.

The invention provides thermal fixing devices of the following two types. Further, the invention provides image forming apparatuses provided with the thermal fixing devices of the following two types, respectively. Further, the invention provides methods of energizing the heating members of the following two types, respectively.

A thermal fixing device of one type according to the invention includes:

- a heating member having a plurality of resistance heating material layers;
- a power source circuit including a first circuit for energizing at least one of the plurality of resistance heating material layers smaller in number than all the resistance heating material layers, and a second circuit for energizing all the resistance heating material layers; and
- a controller for performing energizing by the first circuit until a predetermined time elapses after start of temperature rising of the heating member, and performing energizing by the second circuit after elapsing of the predetermined time.

The invention also provides an image forming apparatus provided with the thermal fixing device of the above first type.

A thermal fixing device of the other type according to the invention includes:

- a heating member having a plurality of resistance heating material layers;
- a temperature sensor detecting a temperature of the heating member;
- a power source circuit including a first circuit for energizing at least one of the plurality of resistance heating material layers smaller in number than all the resistance heating material layers, and a second circuit for energizing all the resistance heating material layers; and
- a controller for performing energizing by the first circuit until the temperature sensor detects a predetermined temperature after start of temperature rising of the heating member, and performing energizing by the second circuit after the detection of the predetermined temperature.

The invention also provides an image forming apparatus provided with the thermal fixing device of the above second type.

The image forming apparatus is not particularly restricted, and may be a printer, a copying machine or the like of an electrophotographic type or a direct recording type.

In either of the thermal fixing devices of the above types, a composite resistance value of all the resistance heating material layers, which are energized by the second circuit in the power source circuit, may be smaller than a composite resistance value of the one or more resistance heating material layers which are energized by the first circuit.

After the predetermined time elapses in the thermal fixing device of the first type, and after the predetermined temperature is detected in the thermal fixing device of the second type, the input current supplied to the resistance heating material layers from the second circuit may be restricted to or below a predetermined restricted current.

In either type of the thermal fixing devices, the input current supplied to the resistance heating material layer(s) from the first circuit may be restricted to or below a predetermined restricted current.

The heating member may be a thermal fixing roller having a roller form.

If the heating member is the thermal fixing roller, the thermal fixing roller may include a core roller made of an electrically conductive material and also serving as the resistance heating material layer, and the resistance heating material layer, which is formed on an inner or outer peripheral surface of the core roller with an insulating layer therebetween and is independent of the resistance heating material layer formed of the core roller.

The core roller may be the resistance heating material layer energized by the first circuit.

After the heating member reaches the fixing allowing temperature in the thermal fixing device of the first type, and after the temperature sensor detects the fixing allowing temperature in the thermal fixing device of the second type, only the first circuit may perform the energizing for controlling the temperature of the heating member.

One of methods of energizing the heating member according to the invention corresponds to the thermal fixing device of the first type, and the other corresponds to the thermal fixing device of the second type.

More specifically, the invention provides a method of energizing a heating member provided in a thermal fixing device and generating heat when energized, wherein

- a heating member having a plurality of resistance heating material layers is employed as the heating member;
- a power source circuit including a first circuit for energizing at least one of the plurality of resistance heating material layers smaller in number than all the resistance heating material layers, and a second circuit for energizing all the resistance heating material layers is employed; and
- energizing by the first circuit is performed until a predetermined time elapses after start of temperature rising of the heating member, and energizing by the second circuit is performed after elapsing of the predetermined time.

Further, the invention provides a method of energizing a heating member provided in a thermal fixing device and generating heat when energized, wherein

- a heating member having a plurality of resistance heating material layers is employed as the heating member;
- a power source circuit including a first circuit for energizing at least one of the plurality of resistance heating material layers smaller in number than all the resistance heating material layers, and a second circuit for energizing all the resistance heating material layers is employed;

the temperature of the heating member is detected by a temperature sensor; and energizing by the first circuit is performed until the temperature sensor detects a predetermined temperature after start of temperature rising of the heating member, and energizing by the second circuit is performed after the detection of the predetermined temperature.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
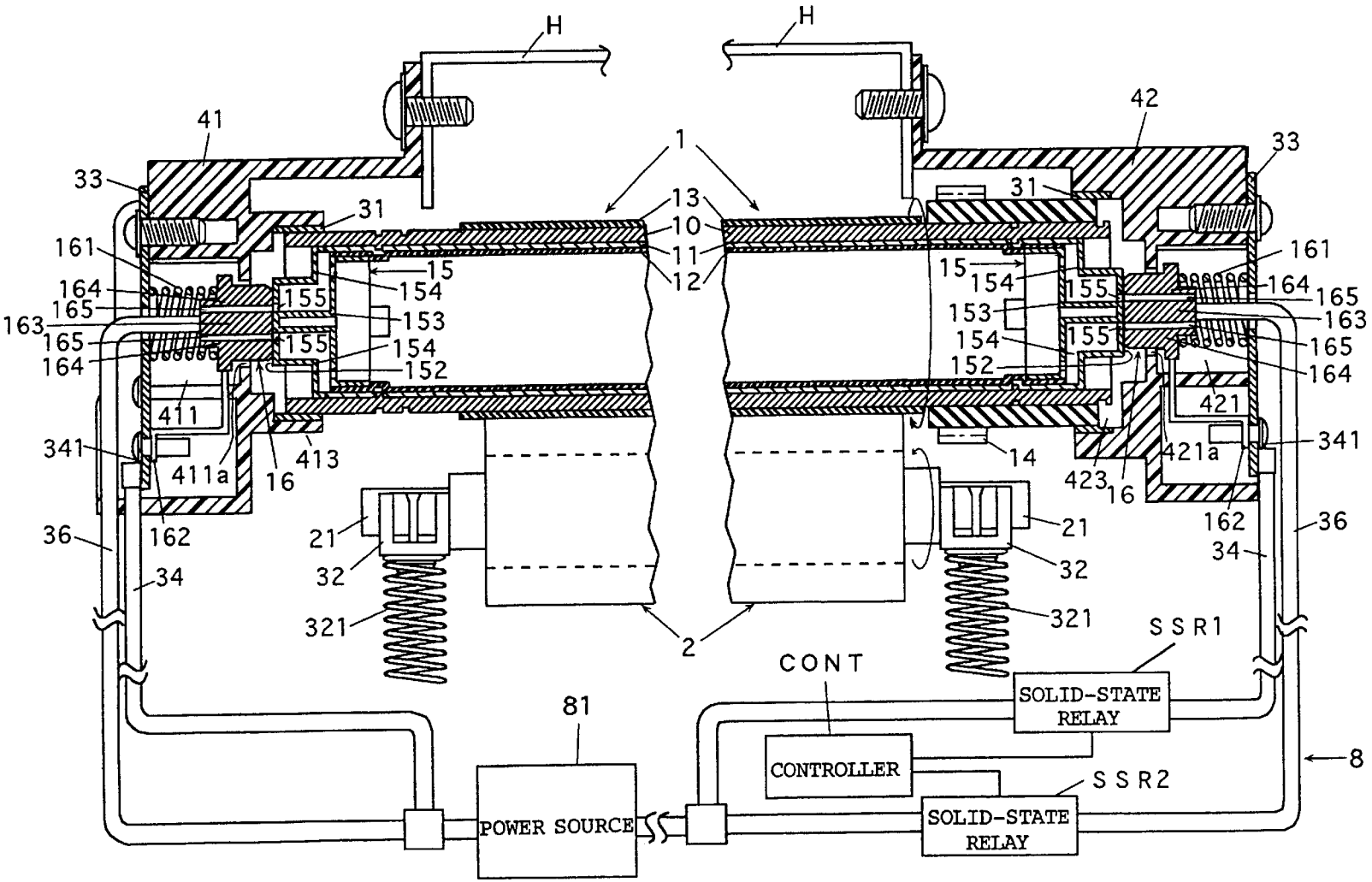
FIG. 1 is a schematic cross section of a thermal fixing device of an embodiment of the invention.

The thermal fixing device of the first type according to the invention have, for example, the following specific structures.

The thermal fixing device includes:

a thermal fixing roller having first and second resistance heating material layers;

a power source circuit for connecting the first resistance heating material layer to a power source via a first switch, and connecting the second resistance heating material layer to the power source via a second switch; and a controller keeping only the first switch on until a first predetermined time elapses after start of temperature rising of the thermal fixing roller, and subsequently turning the first switch on and turning a second switch on after elapsing of the first predetermined time, wherein the power source connects the first and second resistance heating material layers in parallel to the power source.

For example, a composite resistance value of the first and second resistance heating material layers may be smaller than a resistance value of the first resistance heating material layer after the first predetermined time elapses.

The first predetermined time may be determined to flow a current not exceeding a restricted current through the power source circuit when the first and second switches are turned on.

The controller may control on/off of only the first switch for controlling the temperature of the thermal fixing roller after the first predetermined time and a second predetermined time subsequent to the first predetermined time elapse.

The thermal fixing device of the second type according to the invention have, for example, the following specific structures.

The thermal fixing device includes:

a thermal fixing roller having first and second resistance heating material layers;

a temperature sensor for detecting a temperature of the thermal fixing roller;

a power source circuit for connecting the first resistance heating material layer to a power source via a first switch, and connecting the second resistance heating material layer to the power source via a second switch; and a controller keeping only the first switch on until the temperature sensor detects a first predetermined temperature after start of temperature rising of the thermal fixing roller, and subsequently turning the first switch on and turning the second switch on after detection of the first predetermined temperature, wherein the power source circuit connects the first and second resistance heating material layers in parallel to the power source.

In the above thermal fixing device, for example, a composite resistance value of the first and second resistance heating material layers may be smaller than a resistance value of the first resistance heating material layer after the first predetermined temperature is detected.

The first predetermined temperature may be determined to flow a current not exceeding a restricted current through the power source circuit when the first and second switches are turned on.

The controller may control on/off of only the first switch for controlling the temperature of the thermal fixing roller after the first predetermined temperature is detected and further a second predetermined temperature is detected.

The invention may provide, as preferred embodiments, the following first and second thermal fixing devices.

(1) First Thermal Fixing Device

A thermal fixing device for thermally fixing an unfixed image carried on a record medium onto the record medium, including:

a thermal fixing roller including at least two resistance heating material layers;

a power source circuit capable of forming a first circuit for energizing at least one or more of the plurality of resistance heating material layers smaller in number than all the resistance heating material layers, and a second circuit for energizing all the resistance heating material layers used for fixing the unfixed image among all the resistance heating material layers; and a controller for controlling energizing of each of the resistance heating material layers by the power source circuit, wherein the controller controls the power source circuit such that the first circuit is formed until a predetermined time elapses after start of the temperature rising of the thermal fixing roller, and the second circuit is formed after elapsing of the predetermined time, the first circuit restricts the input current supplied to the one resistance heating material layer or the two or more resistance heating material layers forming the first circuit to or below a predetermined restricted current until the predetermined time elapses, and the second circuit operates such that, after elapsing of the predetermined time, the composite resistance value of all the resistance heating material layers used for fixing the unfixed image is lower than the resistance value of the one resistance heating material layer forming the first circuit or the composite resistance value of the two or more resistance heating material layers forming the first circuit, and the input current supplied to all the resistance heating material layers used for fixing the unfixed image and having the composite resistance determining the input current does not exceed a predetermined restricted current.

(2) Second Thermal Fixing Device

A thermal fixing device for thermally fixing an unfixed image carried on a record medium onto the record medium, including:

a thermal fixing roller including at least two resistance heating material layers;

a power source circuit capable of forming a first circuit for energizing at least one or more of the plurality of resistance heating material layers smaller in number than all the resistance heating material layers, and a second circuit for energizing all the resistance heating material layers used for fixing the unfixed image among all the resistance heating material layers;

a controller for controlling energizing of each of the resistance heating material layers by the power source circuit; and a device for detecting the temperature of the thermal fixing roller, wherein the controller controls the power source circuit such that the first circuit is formed until the temperature detecting device detects a predetermined temperature after start of the temperature rising of the thermal fixing roller, and the second circuit is formed after the temperature detecting device detects the predetermined temperature, the first circuit restricts the input current supplied to the one resistance heating material layer or the two or more resistance heating material layers forming the first circuit to or below a predetermined restricted current until the temperature detecting device detects the predetermined temperature, and the second circuit operates such that, after the temperature detecting device detects the predetermined temperature, the composite resistance value of all the resistance heating material layers used for fixing the unfixed image is lower than the resistance value of the one resistance heating material layer forming the first circuit or the composite resistance value of the two or more resistance heating material layers forming the first circuit, and the input current supplied to all the resistance heating material layers used for fixing the unfixed image and having the composite resistance determining the input current does not exceed a predetermined restricted current.

According to each of the first and second thermal fixing devices, the temperature of the thermal fixing roller is raised from a room temperature (i.e., a temperature of the thermal fixing roller before heating) to the predetermined temperature suitable to fixing (e.g., 150° C. to 200° C., although not restricted thereto). For this temperature rising, the power source circuit operates in accordance with instructions of the controller such that only the first circuit is initially formed, and the first circuit energizes the one or more resistance heating material layers in the first circuit. When the first circuit energizes the resistance heating material layer(s), the input current, which is supplied to the one resistance heating material layer or the two or more resistance heating material layers forming the first circuit, is restricted to or below the predetermined restricted current.

Thus, the resistance of the resistance heating material layer increases with increase in temperature of the resistance heating material layer itself, and the input current, which is supplied to the one resistance heating material layer or the two or more resistance heating material layers, is restricted to or below the predetermined restricted current until the predetermined time elapses after start of the temperature rising of the energized thermal fixing roller in the first thermal fixing device, or until the temperature detected by the temperature detecting device reaches the predetermined temperature in the second thermal fixing device. In the case of the one resistance heating material layer, the resistance heating material layer, which achieves the input current not exceeding the restricted current even at the start of energizing, is employed as the above one resistance heating material layer. In the case of the two or more resistance heating material layers, each of the resistance heating material layers is selectively employed and connected such that the input current not exceeding the restricted current is achieved even at the start of energizing.

As already described, the resistance heating material layer has such a feature that the resistance value thereof is low when its temperature is low, and the resistance thereof rises with temperature. If all the resistance heating material layers used for fixing the unfixed image were energized even in the initial stage without using the first circuit described above, the current supplied to these resistance heating material layers might exceed the restricted current. However, the above disadvantage does not occur owing to employment of the first circuit.

If only the first circuit were used for raising the temperature of the thermal fixing roller, the temperature rising rate of the roller would be low because the resistance value of the resistance heating material layer increases with temperature thereof, and therefore the current flowing therethrough gradually decreases. In contrast to this, the first thermal fixing device employs the second circuit after elapsing of the predetermined time, and the second thermal fixing device employs the second circuit after detection of the predetermined temperature by the temperature detecting device.

The predetermined time used in the first thermal fixing device, and the predetermined temperature used in the second thermal fixing device may be determined in advance, e.g., by experiments such that the input current supplied to the resistance heating material layer can be restricted to or below the predetermined restricted current even when the circuit is switched to the second circuit, and that the high temperature rising rate of the thermal fixing roller can be achieved while keeping the input current not exceeding the restricted current. The determination of the above predetermined time and the predetermined temperature can be performed in accordance with a kind and a size of the employed resistance heating material layer, a state of connection thereof, a material and a heat capacity of a member provided with the resistance heating material layer, and others.

After the predetermined time elapses in the first thermal fixing device, and after the predetermined temperature is detected in the second thermal fixing device, the second circuit is formed in the power circuit in accordance with the instruction from the controller so that all the resistance heating material layers used for fixing the unfixed image are energized.

When the second circuit energizes the resistance heating material layers, the input current supplied to the resistance heating material layers used for fixing the unfixed image is restricted to or below the predetermined restricted current.

Although the input current is restricted to or below the restricted current when energizing the resistance heating material layers by the second circuit, the resistance value of the composite resistance of all the resistance heating material layers used for fixing the unfixed image is lower than the resistance value of the composite resistance of the one resistance heating material layer or the two or more resistance heating material layers forming the first circuit. Therefore, the second circuit increases the current and the Joule thermal loss of the resistance heating material layers. Further, the resistance heating material layers energized by the second circuit increase in number so that the temperature rising rate of the thermal fixing roller is not reduced to a practically unignorable extent, and the thermal fixing roller can be rapidly heated to the predetermined fixing temperature.

Among all the resistance heating material layers forming the second circuit, the layers except for that or those forming the first circuit are selectively employed such that the current not exceeding the restricted current can be achieved, and that the resistance value of the composite resistance can be reduced, and are connected to the one resistance heating material layer or the two or more resistance heating material layers forming the first circuit. The manner of this connection is generally determined to reduce the resistance value of the composite resistance, and for this purpose, such a specific connection manner may be employed that each of the resistance heating material layers forming the second circuit but not forming the first circuit is connected in parallel to the one resistance heating material layer or the two or more resistance heating material layers forming the first circuit.

Owing to the above structures, each of the first and second thermal fixing devices can raise the temperature of the thermal fixing roller to the predetermined temperature while restricting the current flowing through the resistance heating material layers of the thermal fixing roller to or below the predetermined restricted current without decreasing the temperature rising rate of the fixing roller.

In each of the first and second thermal fixing devices, it is not necessary to employ the second circuit after the thermal fixing roller reaches the predetermined fixing temperature suitable to the fixing of the unfixed image. For example, an appropriate circuit which can maintain the predetermined fixing temperature may be formed and employed in the power source circuit.

The restricted current value described above may be 15 A, which is a rated current value of the usually used supplied power source.

In each of the first and second thermal fixing devices, the power source circuit and the controller for controlling the same may have, e.g., the following structures.

The power source circuit may include a circuit, in which each of the resistance heating material layers is connected in series to a switch device such as an SSR (solid-state relay) or a photo-coupler formed of a combination of photo-semiconductors, and a plurality of sets each including the switching device and the resistance heating material layer thus connected in series are connected in parallel. The controller may have such a structure that forms the first circuit by turning on only the switch device(s), among the switch devices in the power source circuit, connected in series to the one or more resistance heating material layers for forming the first circuit, and forms the second circuit by turning on all the switch devices connected in series to all the resistance heating material layers used for fixing the unfixed image.

In each of the thermal fixing devices of the first and second fixing devices, the thermal fixing roller may include a hollow core roller made of an electrically conductive material and also serving as one of the plurality of resistance heating material layers, and the other of the plurality of resistance heating material layers may be arranged over the outer and/or inner peripheral surface of the core roller with an electrically insulating layer therebetween. In this structure, the core roller may also serve as the resistance heating material layer for forming the first circuit.

The hollow core roller made of the electrically conductive material described above may be formed of, e.g., a carbon steel pipe, a stainless steel pipe or an aluminum alloy pipe.

If the core roller is made of the electrically conductive material, the resistance heating material layers other than that forming the core roller may be made of carbon or the like containing palladium silver and may be formed over the outer and/or inner peripheral surface of the core roller with an electrically insulating layer therebetween.

A releasing layer made of fluorine-contained resin such as polytetrafluorethylene may be formed on the outermost peripheral surface of the hollow core roller for forming the outermost layer which increases the releasability.

Embodiments of the thermal fixing device and the method of energizing the heating member according to the invention will now be described below with reference to the drawings.

FIG. 1 is a schematic cross section showing an example of the thermal fixing device of an embodiment of the invention. This thermal fixing device is provided for thermally fixing an unfixed toner image carried on a sheet-like record medium onto the same.

The thermal fixing device includes a thermal fixing roller 1 and a pressure roller 2 opposed thereto.

The thermal fixing roller 1 has opposite ends rotatably carried by bearings 31. The bearing 31 on the left side in FIG. 1 is made of synthetic resin and is integrally formed on an inner peripheral surface of a cylindrical projection 413 of a holder 41, which is made of resin and is fixed to a fixing device housing H by screws. The bearing 31 on the right side in FIG. 1 is likewise made of synthetic resin, and is integrally formed on an inner peripheral surface of a concavity 423 having a circular section in a holder 42, which is made of resin and is fixed to the housing H by screws. The thermal fixing roller 1 has a ring gear 14 formed on an outer peripheral surface of its right end. The ring gear 14 can be driven by an electric motor (not shown) via a gear train (not shown) so that the thermal fixing roller 1 is driven to rotate.

The pressure roller 2 has a heat-resistant rubber layer (i.e., silicon rubber layer in this example) having a surface releasability and coated over its core. The pressure roller 2 is provided at its opposite ends with shafts 21, which are rotatably supported by support members 32, and is pushed toward the thermal fixing roller 1 by springs 321 on the common sides of the support members 32. The pressure roller 2 is rotated in accordance with rotation of the thermal fixing roller 1, or in accordance with movement of a record sheet passed between the rollers 1 and 2.

The thermal fixing roller 1 is basically formed of a hollow cylindrical core roller 10 made of an aluminum alloy pipe, and a resistance heating material layer 12 is layered over the inner peripheral surface of the core roller 10 with an electrically insulating layer 11 therebetween. The resistance heating material layer 12 in this example is made of carbon containing palladium silver. A releasing layer 13 is formed over the outer peripheral surface of the core roller 10.

The core roller 10 also serves as a resistance heating material layer, and generates Joule heat when energized. The resistance heating material layer 12 generates Joule heat when energized.

The releasing layer 13 is provided for promoting releasing of a heated toner image from the heating roller 1 when the record sheet carrying the unfixed toner image moves between the thermal fixing roller 1 and the pressure roller 2 opposed thereto. The releasing layer 13 in this example is made of polytetrafluorethylene (PTFE).

These insulating layer 11, resistance heating material layer 12 and releasing layer 13 rotate together with the resistance heating material layer (core roller) 10.

Current receiver members 15 are attached to the axially opposite ends of the thermal fixing roller 1. The current receiver members 15 are fitted onto the inner peripheral surface of the resistance heating material layer (core roller) 10, although not restricted thereto. Each current receiver member 15 has a flat circular top surface 152 coaxial with the roller 1. More specifically, the top surface 152 has an radially inner circular top surface and an annular top surface surrounding the circular top surface.

Each current receiver member 15 is formed of a current receiver terminals 153 and 154 made of an electrically conductive material. These current receiver terminals 153 and 154 are electrically isolated from each other by an insulating ring 155, which is fitted between the radially inner circular top surface and the radially outer annular top surface. The current receiver terminals 153 and 154 are formed integrally with the insulating member 155.

The current receiver terminal 153 is fixed to the resistance heating material layer 12 by electrically conductive adhesive, and is electrically connected to the resistance heating material layer 12. The current receiver terminal 154 is fixed to the resistance heating material layer (core roller) 10 by electrically conductive adhesive, and is electrically connected to the resistance heating material layer (core roller) 10. The current receiver member 15 formed of the current receiver terminals 153 and 154 rotates together with the resistance heating material layer (core roller) 10.

The flat top surface 152 of each current receiver member 15 is in surface-contact with a current supply member 16 located axially (i.e., in the rotation axis direction of the thermal fixing roller 1) outside the current receiver member 15.

Each current supply member 16 has a current supply terminal 163 and a cylindrical current supply terminal 164 which surrounds the current supply terminal 163 with a space therebetween. Both the current supply terminals 163 and 164 are made of an electrically conductive material. The current supply terminals 163 and 164 are electrically isolated from each other by an insulating cylindrical member 165 fitted therebetween, and are formed integrally with the insulating member 165.

The current supply member 16 on the left side in FIG. 1 is fitted into a concavity 411 provided in the holder 41, and has a portion, which is projected through an aperture 411*a* formed on the side of the concavity 411 near the roller 1, and is opposed to the current receiver member 15. The current supply member 16 is biased by a spring 161 fitted into the concavity 411, and thereby is in contact with the current receiver member 15 with an appropriate pressure so that the current supply terminals 163 and 164 are in contact with the current receiver terminals 153 and 154, respectively.

The current supply member 16 on the right side is likewise fitted into a concavity 421 in the holder 42 on the right side, and has a portion, which is projected through a holder aperture 421*a* and is opposed to the current receiver member 15 on the right side. The current supply member 16 on the right side is biased by the spring 161 fitted into the concavity 421, and thereby is in contact with the current receiver member 15 on the right side with an appropriate pressure so that the current supply terminals 163 and 164 on the right side are in contact with the corresponding current receiver terminals 153 and 154, respectively. Each spring 161 is not in contact with the current supply terminal 163, but is in contact with the current supply terminal 164. Thereby, the spring 161 biases the whole current supply member 16 toward the current receiver member 15. Each spring 161 has an axially outer end which is supported by an electrically conductive terminal plate 33 fixed to the outer end of the holder by screws. Owing to the above structure, the current receiver terminals 153 and 154 can keep electrical contact with the current supply terminals 163 and 164, respectively, while the current receiver member 15 is rotating together with the resistance heating material layer (core roller) 10. Each current supply terminal 163 is electrically connected to a wire 36 extending through the terminal plate 33. Each current supply terminal 164 is electrically connected to the terminal plate 33 via a lead wire 162.

The terminal plate 33 on the left side is connected to a wire 34, which is connected to an end of a power source 81 (also see FIG. 3), via a solderless terminal 341. The terminal plate 33 on the right side is connected to the wire 34 via the solderless terminal 341. The wire 34 is connected to the other end of the power source 81 via a first solid-state relay SSR1 (also see FIG. 3). The wire 36 on the left side is connected to one end of the power source 81 (also see FIG. 3). The wire 36 on the right side is connected to the other end of the power source 81 via a second solid-state relay SSR2 (also see FIG. 3). The thermal fixing device is provided with a controller CONT, which will be described later, and the first and second relays SSR1 and SSR2 are connected to the controller CONT.

Figure 2:
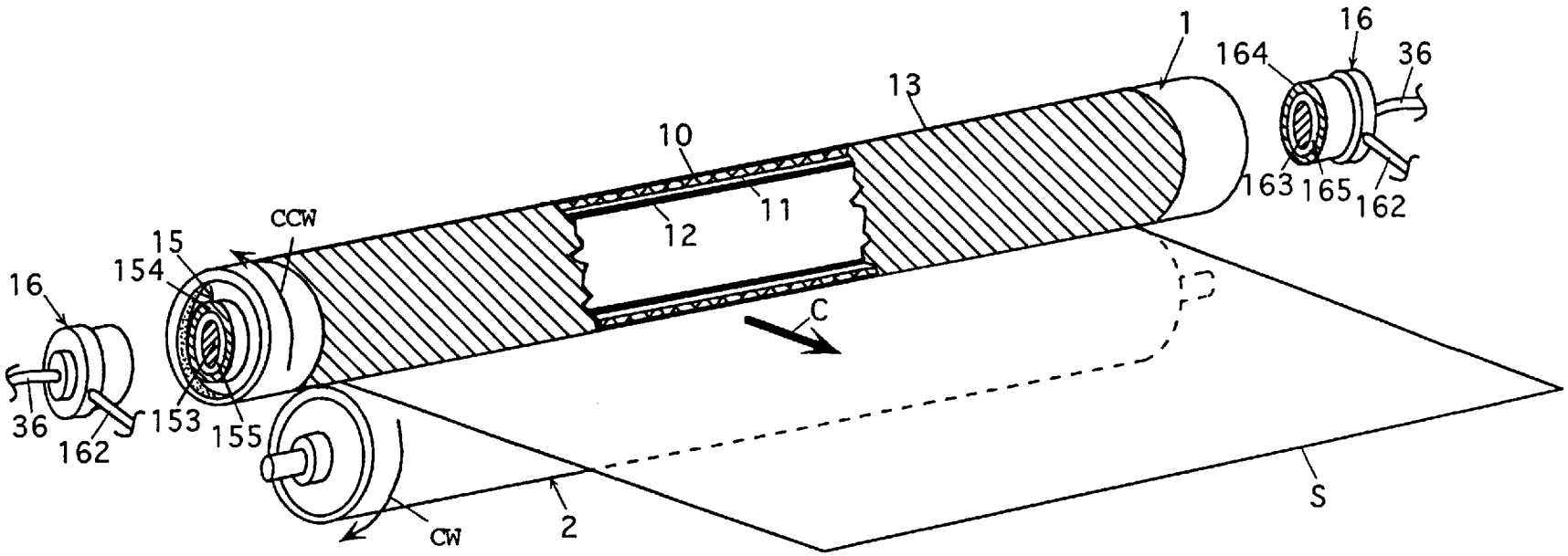
FIG. 2 is a perspective view of a thermal fixing roller and a pressure roller of the thermal fixing device shown in FIG. 1.

FIG. 2 is a perspective view showing the thermal fixing roller 1 and the pressure roller 2 in the thermal fixing device with a certain part cut away. FIG. 2 shows a state of contact between the current receiver member 15 and the current supply member 16, and also shows a state of passing of the record sheet S between the thermal fixing roller 1 and the pressure roller 2.

As already described, the current receiver members 15 are attached to the axially opposite ends of the core roller 10 for rotation together with the core roller 10. Each current supply member 16 is in contact with the axially outer side (i.e., outer side in the rotation axis direction of the core roller 10) of the current receiver member 15.

The above thermal fixing device is mounted on an image forming apparatus such as a copying machine or a printer. The thermal fixing roller 1 rotates counterclockwise direction CCW in the figure, and the pressure roller 2 is driven to rotate clockwise direction CW in the figure. The record sheet S carrying the unfixed toner image is held and passed between the thermal fixing roller 1 and the pressure roller 2. The toner image on the record sheet S moving through the nip portion between the rollers 1 and 2 are melted by the heat applied from the thermal fixing roller heated to the predetermined fixing temperature, and is fixed onto the record sheet S by the pressure applied from the rollers 1 and 2. Thereafter, the record sheet S is transported in accordance with rotation of the thermal fixing roller 1 and the pressure roller 2, and is further transported in a direction indicated by an arrow C in the figure by a discharge roller pair (not shown), whereby the record sheet S is discharged onto a discharged sheet tray.

Figure 3:
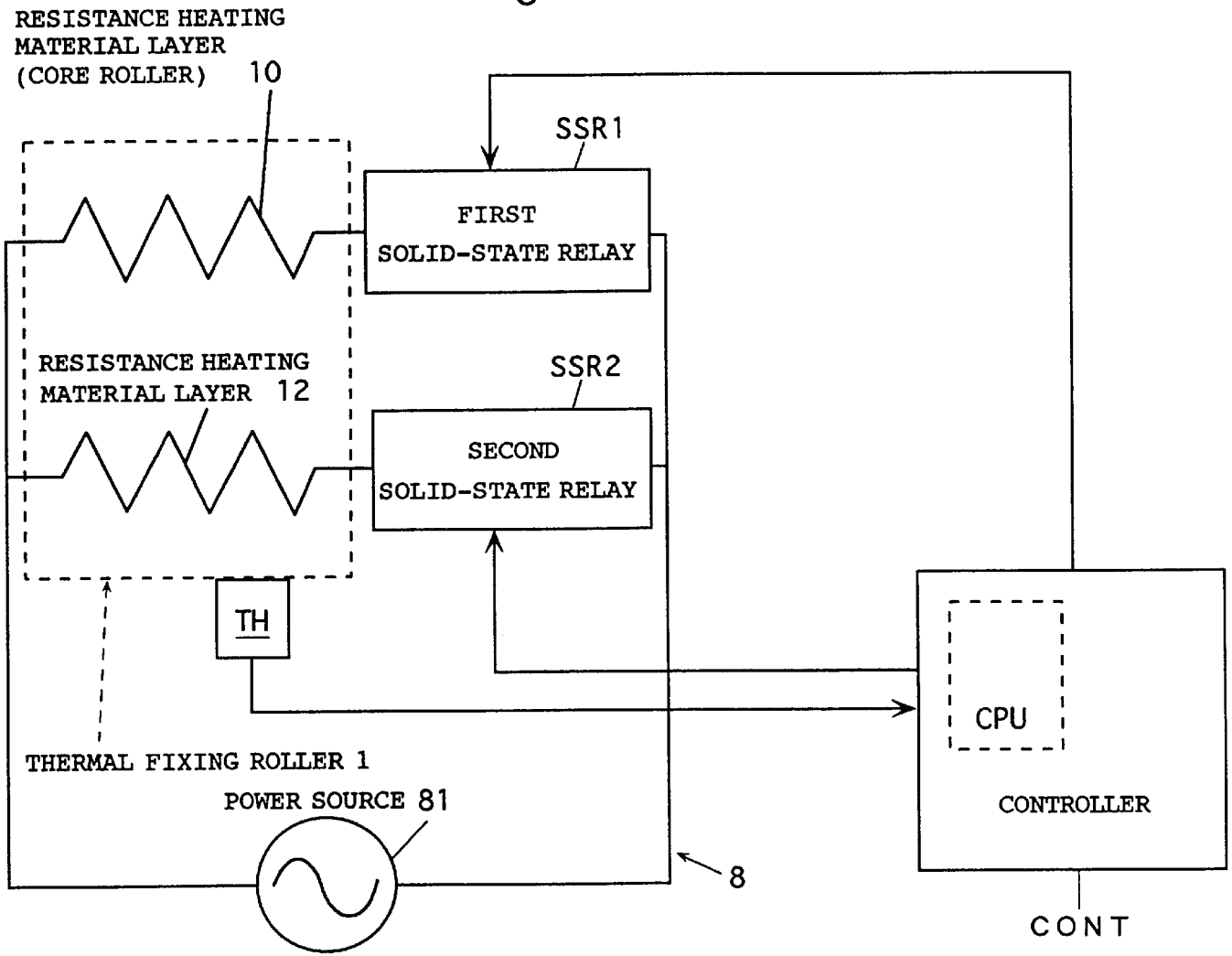
FIG. 3 schematically shows a power source circuit for a core roller serving as a resistance heating material layer and another resistance heating material layer as well as a control circuit for controlling energizing.

FIG. 3 is a schematic block diagram showing the power source circuit 8, which energizes the resistance heating material layer (core roller) 10 and the resistance heating material layer 12, as well as the controller CONT controlling the energizing. FIG. 3 does not show the current receiver member 15, current supply member 16, spring 161, lead wire and others.

The power source 81 can supply AC voltages to the resistance heating material layer (core roller) 10 and the resistance heating material layer 12 by turning on the first and second solid-state relays SSR1 and SSR2 connected in series thereto, respectively. The first and second relays SSR1 and SSR2 are connected to the controller CONT including a central processing unit (CPU) which performs operation control of the whole thermal fixing device, and the controller CONT turns on/off the first and second relays SSR1 and SSR2. In this example, energizing of the resistance heating material layer (core roller) 10 and the resistance heating material layer 12 are executed and stopped by the first and second relays SSR1 and SSR2, respectively. Instead of the relays SSR1 and SSR2, photo-couplers including combinations of photo-semiconductors may be used for the on/off control.

The controller CONT instructs heating until the thermal fixing roller 1 is heated to a predetermined temperature (200° C. in this example) suitable to the fixing during the temperature rising operation of the thermal fixing roller 1, which will be described later. Thereafter, the second relay SSR2 is kept off, and the first relay SSR1 is turned on/off based on the temperature of the thermal fixing roller 1 detected by a thermistor TH (not shown in FIG. 1), which is a temperature detecting element and is in contact with the outer peripheral surface of the releasing layer 13 of the thermal fixing roller 1. More specifically, based on the temperature of the thermal fixing roller 1 detected by the thermistor TH, the controller CONT controls the energizing of the resistance heating material layer (core roller) 10 to keep the thermal fixing roller 1 at a predetermined temperature.

In addition to the thermistor TH for the temperature control of the thermal fixing roller 1, a temperature detecting element may be provided for preventing abnormal temperature rising of the thermal fixing roller 1. A safety switch to be controlled based on the temperature detected by this temperature detecting element may be arranged in series in a path from the resistance heating material layer (core roller) 10 and the resistance heating material layer 12 to the power source 81. Thereby, the safety switch can interrupt the energizing circuit before the thermal fixing roller 1 and its peripheral parts are thermally damaged, even when the controller CONT cannot normally perform the energizing control and thus the temperature of the thermal fixing roller 1 may rise excessively due to a certain reason. This temperature detecting element may be in contact with the outer peripheral surface of the thermal fixing roller 1. The temperature detecting element may be formed of a thermistor or a thermo-couple. The safety switch having the temperature detecting function may be, e.g., a thermal fuse.

In the thermal fixing device described above, the power source circuit 8 shown in FIGS. 1 and 3 performs the temperature rising operation as will be described below with reference to FIG. 4.

Figure 4:
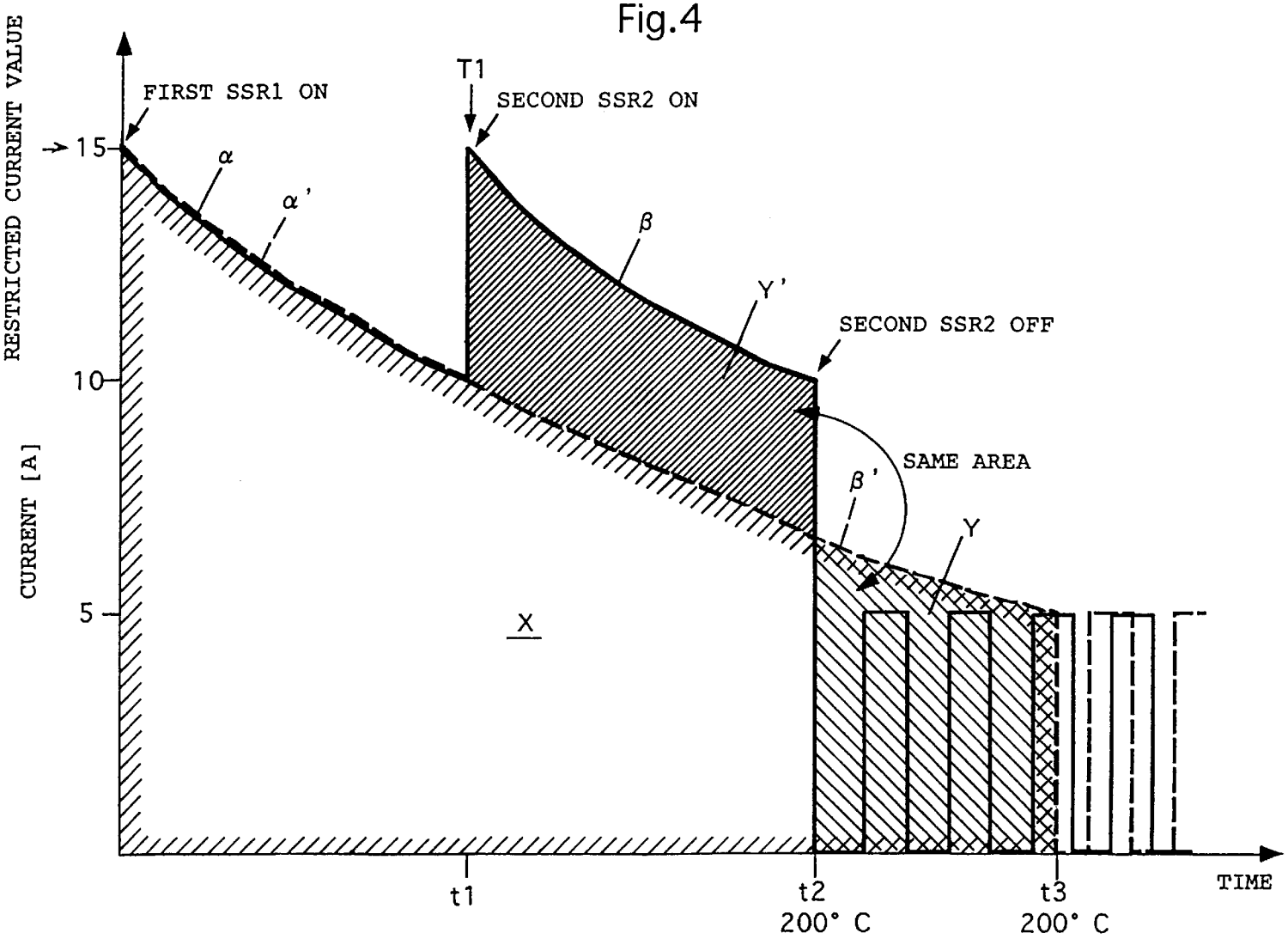
FIG. 4 shows variations in input current value supplied by a power source circuit until a temperature of the thermal fixing roller reaches a predetermined appropriate fixing temperature after start of temperature rising.

FIG. 4 shows variations in value of the input current of the power source circuit 8 which occur until the thermal fixing roller 1 reaches the predetermined appropriate fixing temperature after start of the temperature rising.

In FIG. 4, solid lines α and β show, by way of example, variations in current controlled by the controller according to the invention. Dotted lines α' and β' show variations in current which occur when only the core roller 10 is energized.

In the initial stage of the operation of raising the temperature of the thermal fixing roller 1, the thermal fixing roller 1 is heated from the room temperature (the temperature before the start of heating of the thermal fixing roller 1) as described above. Therefore, the controller CONT forms the first circuit in the power source circuit 8 (see FIG. 3) until a predetermined time t1 elapses. Thus first circuit thus formed can energize only the resistance heating material layer (core roller) 10 between the resistance heating material layer (core roller) 10 and the resistance heating material layer 12. More specifically, the controller CONT turns on the first relay SSR1 and turns off the second relay SSR2 for supplying the AC current only to the resistance heating material layer (core roller) 10 until the predetermined time t1 elapses. The resistance value of the resistance heating material layer in this circuit is the same as the resistance value of the core roller 10, which does not allow the input current value of the resistance heating material layer (core roller) 10 to exceed the restricted current value (15 A in this example) even when the thermal fixing roller 1 is at the room temperature, i.e., when the core roller 10 is still cold and therefore has a low resistance value. In other words, the core roller 10 allowing the above operation is employed.

Owing to the energizing of the circuit which allows energizing of only the resistance heating material layer (core roller) 10, the resistance heating material layer (core roller) 10 rises in temperature, and therefore gradually rises in resistance value. In accordance with this, the input current supplied to the resistance heating material layer (core roller) 10 decreases from about 15 A as depicted by solid and dotted lines α and α' in FIG. 4. Thereby, the current flowing through the resistance heating material layer (core roller) 10 can be restricted to or below the predetermined restricted current in the initial stage of the temperature rising operation of the thermal fixing roller 1. However, if the energizing in the above manner were continued, the resistance heating material layer would rise in temperature, and the input current of the resistance heating material layer (core roller) 10 would further decrease as depicted by dotted line β' in FIG. 4, and would reach about 5 A when the thermal fixing roller 1 reaches the appropriate fixing temperature (200° C. in this example) so that it would take a long time (i.e., a time from the start of temperature rising to the time t3 in FIG. 4) before the thermal fixing roller 1 reaches the appropriate fixing temperature. However, the thermal fixing device of this example performs the following control to increase the temperature rising rate of the thermal fixing roller 1.

When the predetermined time t1 elapses, the controller CONT connects the resistance heating material layer (core roller) 10 and the resistance heating material layer 12 in parallel to the power source circuit 8, and thereby forms the second circuit to be energized. More specifically, the controller CONT turns on both the first and second relays SSR1 and SSR2, and thereby supplies the AC current to both the resistance heating material layer (core roller) 10 and the resistance heating material layer 12. Since the resistance heating material layer (core roller) 10 and the resistance heating material layer 12 are in parallel with each other, the composite resistance value of the circuit thus formed is equal to 1/(1/R1+1/R2), where R1 and R2 represent the resistances of the resistance heating material layers 10 and 12, respectively. Therefore, the above composite resistance value is smaller than the resistance value R1 of the circuit which can energize only the resistance heating material layer (core roller) 10. The above structure is adapted such that the input current value of the resistance heating material layer (core roller) 10 and the resistance heating material layer 12 does not exceed the restricted current value (15 A in this embodiment). Since the resistance values of the resistance heating material layers 10 and 12 depend on the temperatures thereof (and in other words, the temperature of the thermal fixing roller 1 heated by these layers 10 and 12), experiments are performed in advance to determine the temperature (temperature T1 in FIG. 4) of the thermal fixing roller 1, which provides the composite resistance value restricting the input current supplied to the parallel-connected resistance heating material layer (core roller) 10 and resistance heating material layer 12 to or below the predetermined restricted current. The time t1 is determined as the time period which is required for raising the thermal fixing roller 1 from the room temperature to the temperature thus determined. The resistance values of the resistance heating material layer (core roller) 10 and the resistance heating material layer 12 depend on sizes of the resistance heating material layers (e.g., the length in the rotation axis direction of the thermal fixing roller 1, the diameter of the thermal fixing roller 1, the thicknesses of the resistance heating material layers and others) and materials thereof. In view of them, the resistance values of the resistance heating material layer (core roller) 10 and the resistance heating material layer 12 are determined.

After the predetermined time t1 elapses, the resistance heating material layer (core roller) 10 and the resistance heating material layer 12 are energized to raise their temperature so that the resistance values of these resistance heating material layers gradually rise. However, the resistance value of the composite resistance of them is smaller than the resistance value which is exhibited when only the resistance heating material layer (core roller) 10 is energized as already described, and therefore the input current to the parallel-connected resistance heating material layer (core roller) 10 and the resistance heating material layer 12 is relatively large. Accordingly, the Joule heat loss of the resistance heating material layer (core roller) 10 and the resistance heating material layer 12 rises. Further, the two resistance heating material layers 10 and 12 are used. Therefore, the thermal fixing roller 1 can be rapidly raised to the predetermined fixing temperature without a delay in temperature rising rate of the thermal fixing roller 1. In the example shown in FIG. 4, the predetermined fixing temperature of 200° C. is attained at a time t2 before the time t3.

Description will be further given with reference to FIG. 4. Before elapsing of the time t1, only the resistance heating material layer (core roller) 10 is energized. In a period from elapsing of the time t1 to the time t2, the parallel-connected resistance heating material layer (core roller) 10 and the resistance heating material layer 12 are energized to heat the thermal fixing roller 1 to the predetermined fixing temperature of 200° C. The quantity of heat applied in the above operations correspond to a sum of an area Y' of a region, which is defined between the solid line β and the dotted line α' in FIG. 4, and an area X, which is defined under the line α' in FIG. 4 and is represented as a blank region having hatched periphery. In this total area (X+Y'), the area Y' corresponds to the quantity of heat generated by energizing only the resistance heating material layer (core roller) 10 for a period between the times t2 and t3 (i.e., until the predetermined fixing temperature 200° C. is achieved), and in other words the area Y' is equal to an area Y which is obtained by subtracting the foregoing area X from the area under the dotted lines α' and β' in FIG. 4, and thus corresponds to the quantity of heat between the times t2 and t3. Thus, the thermal fixing roller 1 can be rapidly raised to the appropriate fixing temperature by energizing the parallel-connected resistance heating material layer (core roller) 10 and the resistance heating material layer 12 after elapsing of the time t1, i.e., after the composite resistance value of the parallel-connected resistance heating material layer (core roller) 10 and the resistance heating material layer 12 reaches the value preventing the current from exceeding the restricted current. Detection of the predetermined appropriate fixing temperature is performed by the thermistor TH shown in FIG. 3.

In this example, after the thermal fixing roller 1 reaches the predetermined appropriate fixing temperature at the time t2, the controller CONT turns on/off the first relay SSR1 based on the temperature of the thermal fixing roller 1 detected by the thermistor TH as already described. When the fixing roller 1 reaches the predetermined appropriate fixing temperature, the second relay SSR2 is turned off, and will be kept off.

In the fixing device described above, the controller CONT switches the circuit in the power source circuit 8 from the first circuit allowing energizing of only the resistance heating material layer (core roller) 10 to the second circuit allowing energizing of the resistance heating material layer (core roller) 10 and the resistance heating material layer 12 by connecting them in parallel. The controller CONT in the above example determines the timing for the above switching based on the predetermined time t1, which can be determined in advance by experiments or the like. However, a predetermined temperature of the thermal fixing roller 1, at which the thermistor TH can detects similar timing, can be determined in advance by experiments or the like, and the controller CONT can perform the control based on detection of the predetermined temperature by the thermistor TH such that only the resistance heating material layer (core roller) 10 in the power source circuit 8 is energized before the detection of the predetermined temperature, and the resistance heating material layer (core roller) 10 and the resistance heating material layer 12 in the power source circuit 8 are connected in parallel and are energized after the detection.

In the thermal fixing roller 1 described above, the resistance heating material layer 12 is arranged on the inner peripheral surface of the core roller 10. However, it may be arranged on the outer peripheral surface or on both the outer and inner peripheral surfaces.

Another example of the thermal fixing roller according to the invention will be described below with reference to FIG. 5. The thermal fixing roller in this device includes the core roller 10, but the core roller 10 does not serve as the resistance heating material layer.

Figure 5:
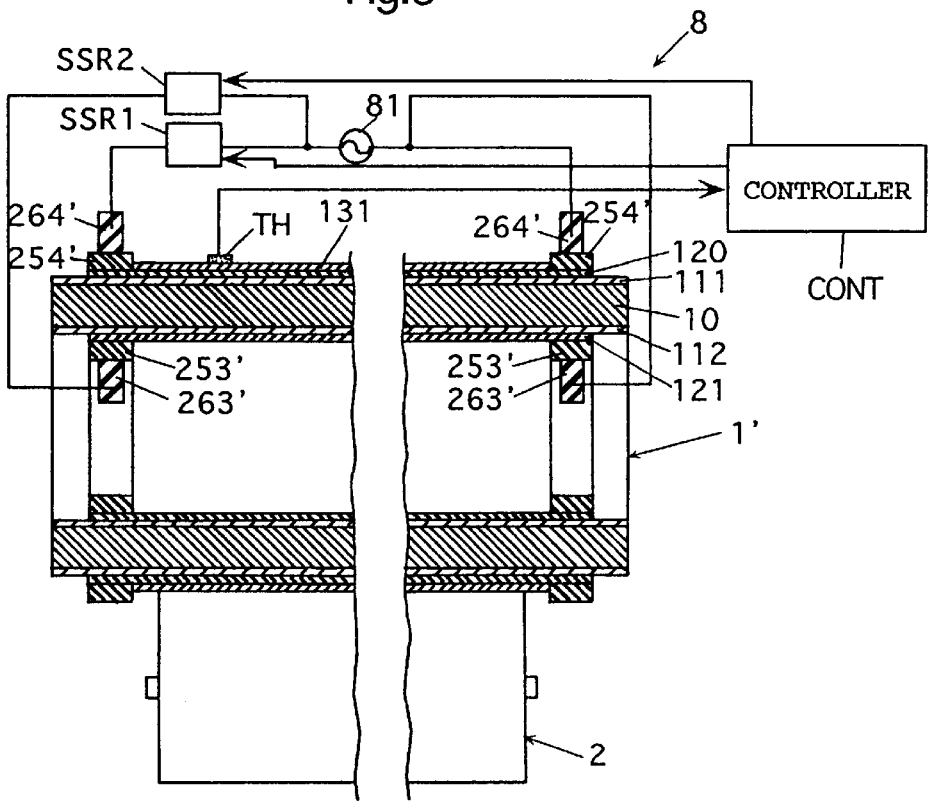
FIG. 5 is a schematic cross section of another example of the thermal fixing device according to the invention.

The thermal fixing device shown in FIG. 5 includes a thermal fixing roller 1', which includes the core roller 10, a resistance heating material layer 120 layered on the outer peripheral surface of the core roller 10 with an electrically insulating layer 111 therebetween, and a resistance heating material layer 121 layered on the inner peripheral surface of the core roller 10 with an electrically insulating layer 112 therebetween. A releasing layer 131 is formed on the outer peripheral surface of the resistance heating material layer 120, and the thermistor TH for detecting the temperature of the thermal fixing roller 1' is in contact with the releasing layer 131.

A pair of ring-shaped current receiver members 254' are fitted around and electrically connected to the resistance heating material layer 120 for slidable contact with current supply members 264' arranged in fixed positions, respectively. One of the current supply members 264' is electrically connected to an end of the AC power source 81, and the other current supply member 264' is connected to the other end of the power source 81 via the first solid-state relay SSR1.

A pair of ring-shaped current receiver members 253' are fitted into and electrically connected to the resistance heating material layer 121 for slidable contact with the current supply members 263' in fixed positions, respectively. One of the current supply members 263' is electrically connected to an end of the AC power source 81, and the other current supply member 263' is connected to the other end of the power source 81 via the second solid-state relay SSR2.

The controller CONT similar to the foregoing controller is arranged, and the relays SSR1 and SSR2 are turned on/off in accordance with instructions from the controller CONT. Information of the detected temperature of the thermistor TH is supplied to the controller CONT.

Similarly to the thermal fixing devices shown in FIGS. 1 to 3, the thermal fixing device in FIG. 5 operates such that the first and second circuits similar to those already described are formed in accordance with instructions from the controller CONT for restricting the current flowing through the resistance heating material layer(s) to or below the predetermined restricted current, and thereby the thermal fixing roller 1' can be rapidly raised to and can be kept at the predetermined fixing temperature.

In contrast to the above, the resistance heating material layer may be eliminated from the inner peripheral surface of the core roller, and two or more resistance heating material layers may be arranged on the outer peripheral surface of the core roller.

Figure 6:
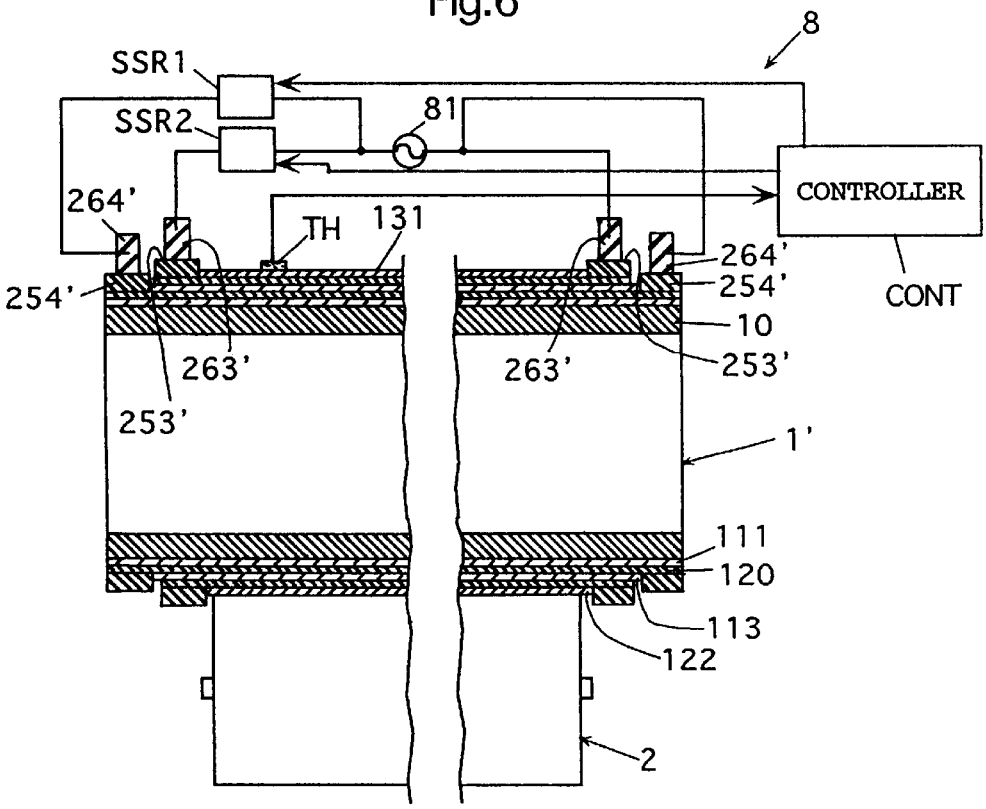
FIG. 6 is a schematic cross section of still another example of the thermal fixing device according to the invention.
Figure 7:
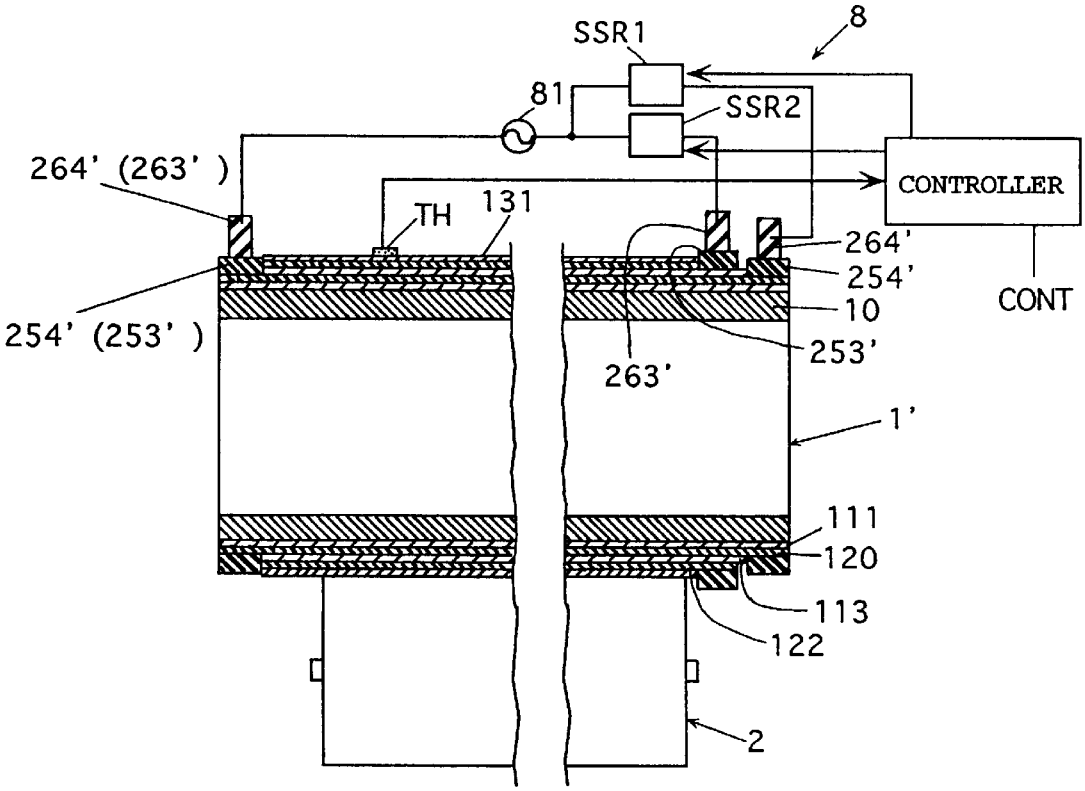
FIG. 7 is a schematic cross section of yet another example of the thermal fixing device according to the invention.

FIG. 6 shows an example, in which two resistance heating material layers 120 and 122 are arranged on the outer peripheral surface of the core roller 10. In FIG. 6, parts and portions having the substantially same functions as those in the fixing device shown in FIG. 5 bear the same reference numbers. In FIG. 6, 113 indicates an insulating layer. The resistance heating material layer may be eliminated from the outer peripheral surface of the core roller, and two or more resistance heating material layers may be arranged on the inner peripheral surface of the core roller. A pair of current receiver members and a pair of current supply members for each of the resistance heating material layers may be independent of those for the other resistance heating material layer(s). Alternatively, two or more of the plurality of resistance heating material layers may be commonly connected to, and thereby may commonly use a common current receiver member and/or a common current supply member, if these receiver and supply members are connected directly to the power source without interposing a switch device such as a solid-state relay to be turned on/off in accordance with the instruction from the controller. An example of this structure is shown in FIG. 7. In FIG. 7, the left current receiver member 254' (253') and the left current supply member 264' (263') are common for the two resistance heating material layers 120, 122.

In any one of the above structures, the power source circuit which can form the first and second circuits is employed, and is controlled by the controller as described above so that the thermal fixing roller can be rapidly raised to and can be kept at the predetermined fixing temperature while restricting the current flowing through the resistance heating material layers to or below the restricted current.

Figure 8:
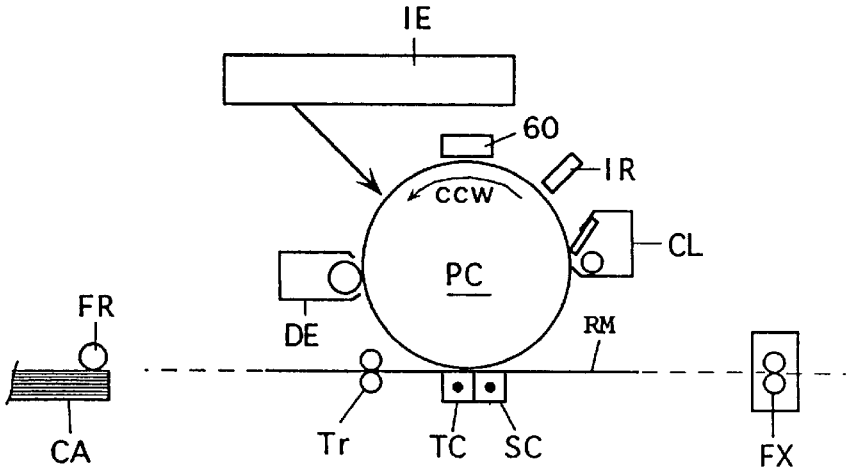
FIG. 8 shows a schematic structure of an example of an image forming apparatus provided with the thermal fixing device according to the invention.

FIG. 8 shows a schematic structure of a printer equipped with one of the thermal fixing devices described above.

A printer PR shown in FIG. 8 includes a photosensitive drum PC, around which a charging device 60, an image exposing device IE, a developing device DE, a transfer charger TC, a separation charger SC, a cleaning device CL and a charge erasing device IR are arranged in this order.

In a travelling direction of a record medium RM, a timing roller pair Tr is arranged upstream to the transfer charger TC, and a record medium supply device including a sheet cassette CA and a sheet feed roller FR is arranged in a further upstream position. A thermal fixing device FX as well as a discharge roller and a discharged sheet tray (both not shown) are arranged downstream from the separation charger SC.

The thermal fixing device shown in FIG. 1 is employed as the thermal fixing device FX. Naturally, any one of the other thermal fixing devices according to the invention may be employed.

According to this printer, the photosensitive drum PC rotates in a counterclockwise direction CCW in the figure, and the charging device 60 uniformly charges the surface of the photosensitive drum PC to have a predetermined potential. The image exposing device IR performs the image exposure corresponding to original image information on the charged region so that an electrostatic latent image is formed. The electrostatic latent image is developed into a visible toner image by the developing device DE.

The record medium RM is supplied from the sheet cassette CA, and is fed to a transfer region by the timing roller pair Tr in synchronization with the toner image on the photosensitive drum. The transfer charger TC transfers the toner image onto the record medium RM thus fed, and then the record medium RM is separated from the photosensitive drum PC by the separation charger SC. The record medium RM thus separated reaches the thermal fixing device FX, in which the toner image is fixed by the heat and pressure, and then is discharged to the discharged sheet tray.

The toner remaining on the photosensitive drum PC after the transfer of toner image is removed by the cleaning device CL, and the residual electric charges on the photosensitive drum are erased by the charge erasing device IR.

According to the printer PR described above, good images can be safely and smoothly produced owing to employment of the thermal fixing device according to the invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A thermal fixing device comprising:

a heating member having a plurality of resistance heating material layers;

a power source circuit including a first circuit for energizing at least one of the plurality of resistance heating material layers smaller in number than all of said resistance heating material layers, and a second circuit for energizing all of said resistance heating material layers; and a controller for performing energizing by said first circuit until a predetermined time elapses after start of temperature rising of said heating member, and performing energizing by said second circuit after elapsing of said predetermined time.

2. The thermal fixing device according to claim 1, wherein a composite resistance value of all the resistance heating material layers energized by said second circuit is smaller than a composite resistance value of the one or more resistance heating material layers energized by said first circuit.

3. The thermal fixing device according to claim 2, wherein an input current supplied to said resistance heating material layers from said second circuit after elapsing of said predetermined time is restricted to or below a predetermined restricted current.

4. The thermal fixing device according to claim 1, wherein an input current supplied to said resistance heating material layer(s) from said first circuit is restricted to or below a predetermined restricted current.

5. The thermal fixing device according to claim 1, wherein said heating member is a thermal fixing roller having a roller form.

6. The thermal fixing device according to claim 5, wherein said thermal fixing roller includes a core roller made of an electrically conductive material and also serving as the resistance heating material layer, and the resistance heating material layer formed on an outer or inner peripheral surface of said core roller with an insulating layer therebetween and being independent of said resistance heating material layer formed of said core roller.

7. The thermal fixing device according to claim 6, wherein said core roller is the resistance heating material layer energized by said first circuit.

8. The thermal fixing device according to claim 1, wherein only said first circuit performs the energizing for controlling the temperature of said heating member after said heating member reaches the fixing allowing temperature.

9. An image forming apparatus comprising:

the thermal fixing device according to claim 1, wherein said thermal fixing device fixes an image onto a record medium.

10. A thermal fixing device comprising:

a thermal fixing roller having first and second resistance heating material layers;

a power source circuit for connecting said first resistance heating material layer to a power source via a first switch, and connecting said second resistance heating material layer to said power source via a second switch; and a controller keeping only said first switch on until a first predetermined time elapses after start of temperature rising of said thermal fixing roller, and subsequently turning said first switch on and turning a second switch on after elapsing of said first predetermined time;

said power source connecting said first and second resistance heating material layers in parallel to the power source.

11. The thermal fixing device according to claim 10, wherein a composite resistance value of said first and second resistance heating material layers is smaller than a resistance value of said first resistance heating material layer after said first predetermined time elapses.

12. The thermal fixing device according to claim 10, wherein said first predetermined time is determined to flow a current not exceeding a restricted current through said power source circuit when said first and second switches are turned on.

13. The thermal fixing device according to claim 10, wherein said controller controls on/off of only said first switch for controlling the temperature of said thermal fixing roller after the first predetermined time and a second predetermined time subsequent to the first oredetermined time elapse.

14. A thermal fixing device comprising:

a heating member having a plurality of resistance heating material layers;

a temperature sensor detecting a temperature of the heating member;

a power source circuit including a first circuit for energizing at least one of the plurality of resistance heating material layers smaller in number than all of said resistance heating material layers, and a second circuit for energizing all of said resistance heating material layers; and a controller for performing energizing by said first circuit until said temperature sensor detects a predetermined temperature after start of temperature rising of said heating member, and performing energizing by said second circuit after the detection of the predetermined temperature.

15. The thermal fixing device according to claim 14, wherein a composite resistance value of all the resistance heating material layers energized by said second circuit is smaller than a composite resistance value of the one or more resistance heating material layers energized by said first circuit.

16. The thermal fixing device according to claim 15, wherein an input current supplied to said resistance heating material layers from said second circuit after the detection of said predetermined temperature is restricted to or below a predetermined restricted current.

17. The thermal fixing device according to claim 14, wherein an input current supplied to said resistance heating material layer(s) from said first circuit is restricted to or below a predetermined restricted current.

18. The thermal fixing device according to claim 14, wherein said heating member is a thermal fixing roller having a roller form.

19. The thermal fixing device according to claim 18, wherein said thermal fixing roller includes a core roller made of an electrically conductive material and also serving as the resistance heating material layer, and the resistance heating material layer formed on an outer or inner peripheral surface of said core roller with an insulating layer therebetween and being independent of said resistance heating material layer formed of said core roller.

20. The thermal fixing device according to claim 19, wherein said core roller is the resistance heating material layer energized by said first circuit.

21. The thermal fixing device according to claim 14, wherein only said first circuit performs the energizing for controlling the temperature of said heating member after said temperature sensor detects the fixing allowing temperature.

22. An image forming apparatus comprising:

the thermal fixing device according to claim 14, wherein said thermal fixing device fixes an image onto a record medium.

23. A thermal fixing device comprising:

a thermal fixing roller having first and second resistance heating material layers;

a temperature sensor for detecting a temperature of said thermal fixing roller;

a power source circuit for connecting said first resistance heating material layer to a power source via a first switch, and connecting said second resistance heating material layer to said power source via a second switch; and a controller keeping said first switch on until said temperature sensor detects a first predetermined temperature after start of temperature rising of said thermal fixing roller, and subsequently turning said first switch on and turning said second switch on after detection of said first predetermined temperature;

said power source connecting said first and second resistance heating material layers in parallel to the power source.

24. The thermal fixing device according to claim 23, wherein a composite resistance value of said first and second resistance heating material layers is smaller than a resistance value of said first resistance heating material layer after the detection of said first predetermined temperature.

25. The thermal fixing device according to claim 23, wherein said first predetermined temperature is determined to flow a current not exceeding a restricted current through said power source circuit when said first and second switches are turned on.

26. The thermal fixing device according to claim 23, wherein said controller controls on/off of only said first switch for controlling the temperature of said thermal fixing roller after the first predetermined temperature is detected and further a second predetermined temperature is detected.

27. A thermal fixing device for thermally fixing an unfixed image carried on a record medium onto said record medium, comprising:

a thermal fixing roller including at least two resistance heating material layers;

a power source circuit capable of forming a first circuit for energizing at least one or more of said plurality of resistance heating material layers smaller in number than all of said resistance heating material layers, and a second circuit for energizing all the resistance heating material layers used for fixing said unfixed image among said resistance heating material layers; and a controller for controlling energizing of each of said resistance heating material layers by said power source circuit, wherein said controller controls said power source circuit such that said first circuit is formed until a predetermined time elapses after start of the temperature rising of said thermal fixing roller, and said second circuit is formed after elapsing of said predetermined time, said first circuit restricts an input current supplied to one resistance heating material layer or two or more resistance heating material layers forming said first circuit to or below a predetermined restricted current until said predetermined time elapses, and said second circuit operates such that, after elapsing of said predetermined time, a composite resistance value of all the resistance heating material layers used for fixing said unfixed image is lower than a resistance value of said one resistance heating material layer forming said first circuit or a composite resistance value of said two or more resistance heating material layers forming said first circuit, and an input current, supplied to all the resistance heating material layers used for fixing said unfixed image and which have the composite resistance that determines said input current, does not exceed a predetermined restricted current.

28. A thermal fixing device for thermally fixing an unfixed image carried on a record medium onto said record medium, comprising:

a thermal fixing roller including at least two resistance heating material layers;

a power source circuit capable of forming a first circuit for energizing at least one or more of said plurality of resistance heating material layers smaller in number than all of said resistance heating material layers, and a second circuit for energizing all the resistance heating material layers used for fixing said unfixed image among said resistance heating material layers;

a controller for controlling energizing of each of said resistance heating material layers by said power source circuit, and a device for detecting the temperature of said thermal fixing roller, wherein said controller controls said power source circuit such that said first circuit is formed until said temperature detecting device detects a predetermined temperature after start of the temperature rising of said thermal fixing roller, and said second circuit is formed after said temperature detecting device detects said predetermined temperature;

said first circuit restricts an input current supplied to one resistance heating material layer or two or more resistance heating material layers forming said first circuit to or below a predetermined restricted current until said temperature detecting device detects said predetermined temperature, and said second circuit operates such that, after said temperature detecting device detects said predetermined temperature, a composite resistance value of all the resistance heating material layers used for fixing said unfixed image is lower than a resistance value of said one resistance heating material layer forming said first circuit or a composite resistance value of said two or more resistance heating material layers forming said first circuit, and an input current, supplied to all the resistance heating material layers used for fixing said unfixed image and which have the composite resistance that determines said input current, does not exceed a predetermined restricted current.

29. A method of energizing a heating member provided in a thermal fixing device and generating heat when energized, wherein a heating member having a plurality of resistance heating material layers is employed as said heating member;

a power source circuit including a first circuit for energizing at least one of said plurality of resistance heating material layers smaller in number than all the resistance heating material layers, and a second circuit for energizing all the resistance heating material layers is employed; and energizing by said first circuit is performed until a predetermined time elapses after start of temperature rising of said heating member, and energizing is performed by said second circuit after elapsing of said predetermined time.

30. A method of energizing a heating member provided in a thermal fixing device and generating heat when energized, wherein a heating member having a plurality of resistance heating material layers is employed as said heating member;

a power source circuit including a first circuit for energizing at least one of the plurality of resistance heating material layers smaller in number than all the resistance heating material layers, and a second circuit for energizing all the resistance heating material layers is employed;

the temperature of said heating member is detected by a temperature sensor; and energizing by said first circuit is performed until said temperature sensor detects a predetermined temperature after start of temperature rising of said heating member, and energizing by said second circuit is performed after said detection of the predetermined temperature.

* * * * *